US008046845B1

(12) United States Patent
Garcia et al.

(10) Patent No.: US 8,046,845 B1
(45) Date of Patent: Nov. 1, 2011

(54) LIGHTWEIGHT COMBAT HELMET

(75) Inventors: Felipe Garcia, Panama City, FL (US); Robert Woodall, Panama City, FL (US); Chris Doyle, Panama City Beach, FL (US); Greg Reitmeyer, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 421 days.

(21) Appl. No.: 12/319,916

(22) Filed: Jan. 9, 2009

(51) Int. Cl.

| | |
|---|---|
| ***F41H 1/04*** | (2006.01) |
| ***A42B 3/06*** | (2006.01) |
| ***A42B 3/12*** | (2006.01) |
| *A42B 3/00* | (2006.01) |

(52) U.S. Cl. ..... 2/413; 2/2.5; 2/410; 2/6.6; 2/411

(58) Field of Classification Search ..... 2/2.5
See application file for complete search history.

(56) References Cited

U.S. PATENT DOCUMENTS

| | | | | | |
|---|---|---|---|---|---|
| 2,605,703 | A | * | 8/1952 | Lawson | 102/306 |
| 2,642,654 | A | * | 6/1953 | Ahrens | 428/566 |
| 3,223,086 | A | * | 12/1965 | Denton | 128/201.24 |
| 3,274,612 | A | * | 9/1966 | Merriam | 2/421 |
| 3,310,811 | A | * | 3/1967 | Iacono, Jr. | 2/6.5 |
| 3,344,433 | A | * | 10/1967 | Stapenhill | 2/420 |
| 3,415,711 | A | * | 12/1968 | Chavannes | 428/166 |
| 3,479,666 | A | * | 11/1969 | Webb | 2/6.6 |
| 3,600,714 | A | * | 8/1971 | Cade et al. | 2/83 |
| 3,609,764 | A | * | 10/1971 | Morgan | 2/414 |
| 3,645,259 | A | * | 2/1972 | Schulman | 128/869 |
| 3,698,670 | A | * | 10/1972 | Ewing | 244/122 AG |
| 3,721,994 | A | * | 3/1973 | DeSimone et al. | 2/410 |
| 3,761,959 | A | * | 10/1973 | Dunning | 2/413 |
| 3,787,893 | A | * | 1/1974 | Larcher | 2/413 |
| 4,035,846 | A | * | 7/1977 | Jencks | 2/413 |
| 4,054,953 | A | * | 10/1977 | De Barsy | 2/414 |
| 4,100,320 | A | * | 7/1978 | Chisum | 428/188 |
| 4,134,155 | A | * | 1/1979 | Robertson | 2/412 |
| 4,324,005 | A | * | 4/1982 | Willis | 2/413 |
| 4,345,338 | A | * | 8/1982 | Frieder et al. | 2/414 |
| 4,467,476 | A | * | 8/1984 | Herbert | 2/2.5 |
| 4,656,667 | A | * | 4/1987 | Blake | 2/5 |
| 4,697,285 | A | * | 10/1987 | Sylvester | 2/2.5 |
| 4,710,984 | A | * | 12/1987 | Asper et al. | 2/412 |
| 4,845,786 | A | * | 7/1989 | Chiarella | 2/412 |
| H000902 | H | * | 4/1991 | Rousseau | 2/414 |
| 5,050,240 | A | * | 9/1991 | Sayre | 2/6.2 |
| 5,083,320 | A | * | 1/1992 | Halstead | 2/413 |
| 5,157,792 | A | * | 10/1992 | Allen et al. | 2/2.5 |
| 5,181,279 | A | * | 1/1993 | Ross | 2/413 |
| 5,259,071 | A | * | 11/1993 | Scott et al. | 2/413 |
| 5,309,576 | A | * | 5/1994 | Broersma | 2/412 |
| 5,337,420 | A | * | 8/1994 | Haysom et al. | 2/410 |
| 5,351,341 | A | * | 10/1994 | Broersma | 2/412 |
| 5,428,845 | A | * | 7/1995 | Deagan | 2/413 |
| 5,477,563 | A | * | 12/1995 | Gentes et al. | 2/411 |
| 5,481,762 | A | * | 1/1996 | Gentes et al. | 2/411 |
| 5,680,656 | A | * | 10/1997 | Gath | 2/424 |

(Continued)

*Primary Examiner* — Bobby Muromoto, Jr.
(74) *Attorney, Agent, or Firm* — James T. Shepherd

(57) ABSTRACT

A lightweight combat helmet has a rigid helmet shell with first and second flexible and fluid impermeable receptacles nested within the helmet shell. The first receptacle is filled with structures and substances that alter a trajectory of an incoming projectile. When filled, the second receptacle conforms to a wearer's head.

31 Claims, 4 Drawing Sheets

U.S. PATENT DOCUMENTS

| | | | | |
|---|---|---|---|---|
| 5,950,244 | A * | 9/1999 | Fournier et al. | 2/414 |
| 6,178,560 | B1 * | 1/2001 | Halstead et al. | 2/413 |
| 6,351,853 | B1 * | 3/2002 | Halstead et al. | 2/413 |
| 6,532,857 | B1 * | 3/2003 | Shih et al. | 89/36.02 |
| 6,591,428 | B2 * | 7/2003 | Halstead et al. | 2/413 |
| 7,010,811 | B1 * | 3/2006 | Park | 2/2.5 |
| 7,300,893 | B2 * | 11/2007 | Barsoum et al. | 442/134 |
| 7,608,322 | B2 * | 10/2009 | Thurau et al. | 428/297.1 |
| 7,685,922 | B1 * | 3/2010 | Martin et al. | 89/36.02 |
| 7,794,808 | B2 * | 9/2010 | Dudt et al. | 428/36.9 |
| 7,861,638 | B1 * | 1/2011 | Percival et al. | 89/36.02 |
| 2002/0178900 | A1 * | 12/2002 | Ghiorse et al. | 89/36.02 |
| 2003/0194463 | A1 * | 10/2003 | Gakovic | 425/352 |
| 2004/0060100 | A1 * | 4/2004 | Reiterman | 2/422 |
| 2005/0166303 | A1 * | 8/2005 | Aaron | 2/422 |
| 2006/0253950 | A1 * | 11/2006 | Kerr | 2/2.5 |
| 2008/0093779 | A1 * | 4/2008 | Cutler et al. | 264/682 |
| 2008/0314237 | A1 * | 12/2008 | Cioffi | 89/36.02 |
| 2009/0025126 | A1 * | 1/2009 | Crossman et al. | 2/456 |
| 2009/0064385 | A1 * | 3/2009 | Crossman et al. | 2/6.6 |

* cited by examiner

LIGHTWEIGHT COMBAT HELMET

ORIGIN OF THE INVENTION

The invention described herein was made in the performance of official duties by employees of the Department of the Navy and may be manufactured, used, licensed by or for the Government without payment of any royalties thereon.

CROSS-REFERENCE TO RELATED PATENT APPLICATIONS

This patent application is co-pending with one related patent application entitled "LIGHTWEIGHT COMBAT HELMET" (Navy Case No. 98800) by the same inventors as this patent application.

FIELD OF THE INVENTION

The invention relates generally to combat helmets, and more particularly to a lightweight combat helmet that alters a projectile's trajectory as the projectile passes through a filled receptacle thereof.

BACKGROUND OF THE INVENTION

State-of-the-art combat helmets used by the military and police riot/SWAT forces are constructed from layers of fabric (e.g., commercially-available aramid fabrics such as SPECTRA, KEVLAR, etc., or polypropylene, polyethylene or high-performance P-phenylene benzobisoxazole (PB0) fibers arrayed as a fabric) placed within a matrix of molded epoxy resin that has been allowed to cure into the shape of a helmet. In the current art, the only methods used to increase ballistic protection have come about by adding thicker layers of fabric material together with heavy plastic, epoxy, and/or polyethylene agents molded into the form of a helmet. These methods increase the weight and cost of the protective helmets without providing a comfort fit to the wearer.

Current helmet designs weigh on the order of four pounds. This is a substantial amount of weight that must be supported by one's neck for long periods of time, in fast-paced combat situations, and/or in combat situations requiring one to swim or float in water.

SUMMARY OF THE INVENTION

Accordingly, it is an object of the present invention to provide a combat helmet that offers the wearer protection from an incoming projectile.

Another object of the present invention is to provide a lightweight combat helmet.

Other objects and advantages of the present invention will become more obvious hereinafter in the specification and drawings.

In accordance with the present invention, a lightweight combat helmet has a rigid helmet shell having a concave inner surface. A first flexible and fluid impermeable receptacle defines a helmet shape that nests within the helmet shell when the first receptacle is filled. The first receptacle is coupled to the concave inner surface of the helmet shell and is filled with structures and substances that alter a trajectory of a projectile entering the first receptacle. A second flexible and fluid impermeable receptacle nests within the first receptacle and is adapted to conform to a wearer's head when the second receptacle is filled with structures and substances.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Prior to describing the combat helmet of the present invention, an inflatable trajectory altering system that forms a core element for the combat helmet will first be described. Details of this core element can be found in each of U.S. Pat. Nos. 6,997,218 and 7,213,497, the contents of which are hereby incorporated by reference. However, in order to provide a complete description and understanding of the present invention, various embodiments of the core element will be described briefly herein.

Figure 1:
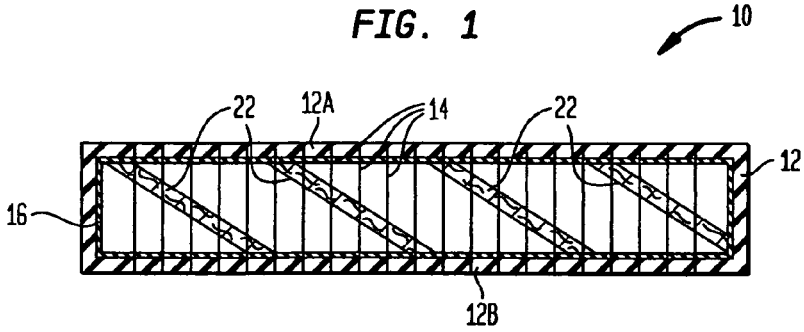
FIG. 1 is a cross-sectional view of one embodiment of an inflatable trajectory altering system used in the lightweight combat helmet of the present invention.

Referring now to the drawings, and more particularly to FIG. 1, one embodiment of an inflatable trajectory altering system used by the present invention is shown in its inflated state and is referenced generally by numeral 10. System 10 has an outer wall structure 12 made from a flexible and fluid-impermeable material that defines a plenum. More specifically, wall structure 12 has major opposing walls 12A and 12B that are spaced apart from one another when the interior volume defined by wall structure 12 is inflated with a lightweight substance such as air or foam (not shown). The means used to inflate wall structure 12 can be any compressed air (or other fluid) inflation system, an expandable foam sprayer, etc., and is not a limitation of the present invention. Inflation of system 10 can occur just prior to use thereof or during the manufacture thereof without departing from the scope of the present invention. Also, the material used for wall structure 12 can be selected from a wide variety of well known flexible and fluid-impermeable materials and is, therefore, not a limitation of the present invention.

In general, trajectory altering system 10 includes one or more types of materials and substances disposed within and filling the plenum defined by wall structure 12. For the illustrated embodiment, flexible lines 14 are coupled to and span major opposing walls 12A and 12B such that lines 14 are placed in tension when wall structure 12 is inflated with a gas, fluid, foam, etc. Each of lines 14 can be made from a single fiber strand or multiple strands of fiber. In general, lines 14 should possess a high tensile strength and be abrasion resistant. Thus, a variety of polymer materials can be used for lines 14 with certain commercially-available products being preferred when system 10 is to be used to alter the trajectory of an incoming projectile. For example, lines 14 can be fibers made from the well-known polymeric strength materials SPECTRA available from Honeywell International Inc., KEVLAR available from E.I. du Pont de Nemours and Company, ZYLON available from Toyobo Company Ltd., TWARON available from Akzo Nobel, DYNEEMA available from Koninklijke DSM N.V., and nylon, just to name a few.

Attachment of lines 14 to major opposing walls 12A and 12B is preferably accomplished by a method known as "drop stitching" which maintains the sealed and fluid-impermeable integrity of wall structure 12. Drop stitching methods are known in the art of inflatable watercraft construction. See, for example, U.S. Pat. No. 6,074,261, the contents of which are hereby incorporated by reference. The lengths of lines 14 can be varied to shape the outer contours of an inflated wall structure 12 for a particular application, e.g., a combat helmet.

The interior surfaces of wall structure 12 can be optionally coated or covered with a viscous polymeric sealing material layer 16 that serves to seal itself in the event of a small puncture. Examples of such sealing material constructions are disclosed in U.S. Pat. Nos. 4,501,035 and 5,295,525, the contents of which are hereby incorporated by reference.

System 10 further includes the use of ballistic armor fabric sheets within wall structure 12. As used herein, the terms "ballistic armor fabric sheet", "ballistic armor fabric" and/or "ballistic fabric", refer to any flexible but high-strength fabric that is accepted as having ballistic protection properties in the field of ballistic protection systems. Currently, such fabrics include the previously-mentioned SPECTRA, KEVLAR, TWARON and DYNEEMA. However, it is to be understood that the present invention could utilize other ballistic armor fabric sheets as such are developed.

In FIG. 1, a plurality of ballistic armor fabric sheets 22 are arranged within wall structure 12 in a spaced-apart and substantially parallel fashion to form an angular relationship with lines 14 when lines 14 are in tension. Ends of sheets 22 can be coupled to wall structure 12 in a variety of ways. For example, the ends of sheets 22 can be adhered to wall structure 12 with an adhesive and then stitched in place when lines 14 are stitched in. Lines 14 are passed through sheets 22 during the stitching process. The presence of sheets 22 aids in altering a projectile's trajectory and absorbs energy from the projectile. Briefly, when an incoming projectile impacts one of sheets 22, the impacted sheet deflects to absorb energy and defines an angular path for the projectile to follow. If/when a projectile passes through one of sheets 22, the projectile encounters another sheet 22 where its trajectory is again altered and its energy is absorbed.

Figure 2:
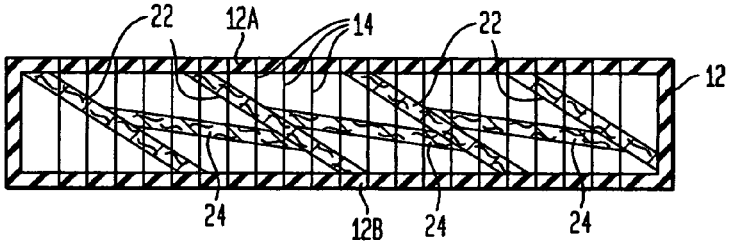
FIG. 2 is a cross-sectional view of another embodiment of an inflatable trajectory altering system that includes the use of a matrix of ballistic armor fabric sheets.
Figure 3:
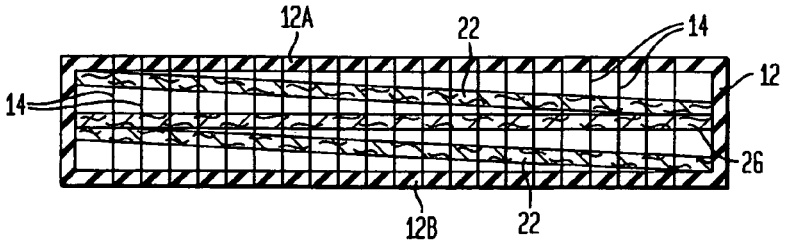
FIG. 3 is a cross-sectional view of another embodiment of an inflatable trajectory altering system that includes the use of a matrix of ballistic armor fabric sheets.

In FIG. 2, another embodiment of a trajectory altering system is shown. More specifically, sheets 22 are tethered to one another by ballistic armor fabric sheets 24 that are angularly disposed with respect to lines 14 and sheets 22. As a result, sheets 22 and 24 form a matrix of sheets that lie on different angles for trajectory alteration. FIG. 3 depicts a similar concept with sheets 26 (only one sheet 26 is shown for clarity of illustration) being interspersed with sheets 22 and substantially parallel to major opposing walls 12A and 12B.

Figure 4:
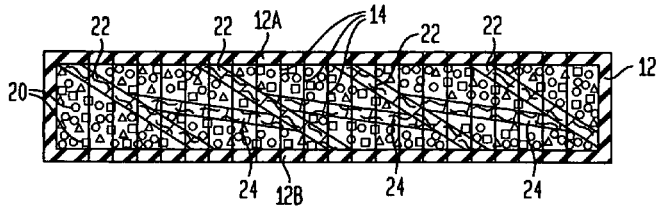
FIG. 4 is a cross-sectional view of another embodiment of an inflatable trajectory altering system that includes the use of shaped objects and a matrix of ballistic armor fabric sheets.

Each of the embodiments shown in FIGS. 1-3 could further include shaped objects partially or completely filling the interior of the wall structure. For example, FIG. 4 illustrates the FIG. 2 embodiment with the further inclusion of shaped objects 20 within wall structure 12.

Figure 5A:
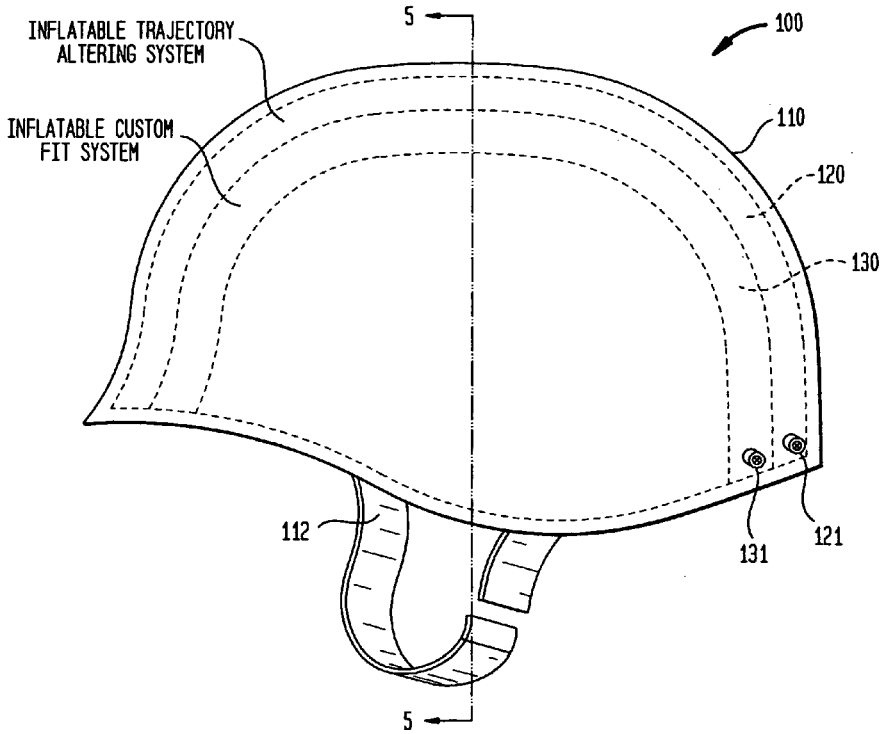
FIG. 5A is a side schematic view of a lightweight combat helmet that includes an inflatable trajectory altering system in accordance with an embodiment of the present invention.
Figure 5B:
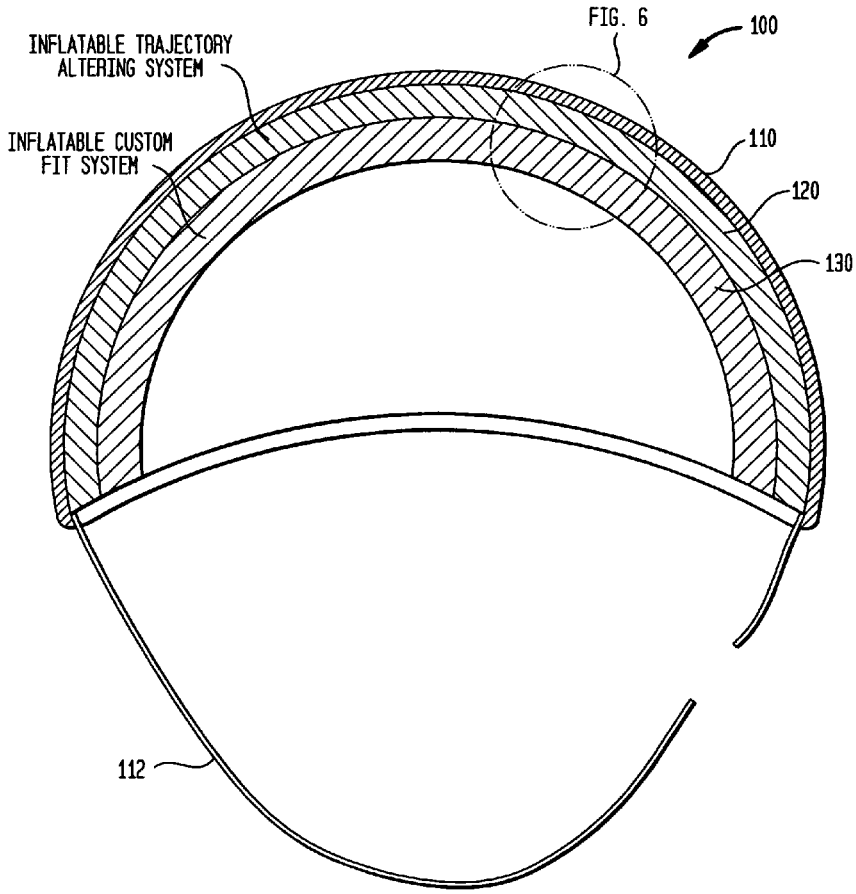
FIG. 5B is a cross-sectional schematic view of the combat helmet taken along line 5-5 in FIG. 5A.

One or more of the above-described inflatable trajectory altering systems can be utilized in the construction of a lightweight combat helmet in accordance with the present invention. Referring now to FIGS. 5A and 5B, a lightweight combat helmet in accordance with the present invention is shown and is referenced generally by numeral 100. In the illustrated embodiment, combat helmet 100 includes a rigid outer helmet shell 110 typically made from a metal or a composite as would be well understood in the art. Nested within rigid helmet shell 110 are an inflatable trajectory altering system 120 and an inflatable custom fit system 130. As will be explained further below, systems 120 and 130 are inflated prior to the use of combat helmet 100. Typically, valves 121 and 131 are provided in systems 120 and 130, respectively, to facilitate such inflation.

Helmet shell 110 can be any suitable helmet shape, the choice of which is not a limitation of the present invention. Trajectory altering system 120 conforms to the inner concave surface of helmet shell 110 after system 120 is "filled" as will be explained further below. Such filling of system 120 is done at least partially in a factory setting, with the remainder being done just prior to going into the "field" or once in the "field." Typically, system 120 will be coupled in any of a variety of ways to the inside of helmet shell 110. The choice of such coupling is not a limitation of the present invention. A chin strap 112 can be attached to or made integral with helmet shell 110 as would be understood in the art.

Helmet shell 110 forms the first line of defense against an incoming projectile. Accordingly, the inner and/or outer surface of helmet shell 110 could also be coated with an epoxy or elastomeric-like paint that includes dust or particles of a hard substance (e.g., diamonds, carborundum, etc.) mixed therein. The "hard substance" particles serve to dull the point of an incoming projectile thereby increasing the effectiveness of trajectory altering system 120. Such coating (e.g., spray coating) of the outer surface of helmet shell 110 could occur prior to or after the inflation of trajectory altering system 120.

The second line of defense against an incoming projectile is formed by trajectory altering system 120 that is the core element of combat helmet 100. Trajectory altering system 120 could be realized by, for example, any of the trajectory altering systems described above and illustrated in FIGS. 1-4. The choice of the particular trajectory altering system can be predicated on various design considerations to include the amount of protection, cost, weight, manufacturing complexity, etc. Prior to the filling/inflation thereof, system 120 will be flaccid.

Inflatable custom fit system 130 is nested within and (typically) coupled to trajectory altering system 120. In general, custom fit system 130 is flaccid prior to the filling/inflation thereof, and conforms to a wearer's head once filled/inflated. Such filling/inflation is done partially in a factory setting with the remainder being done by the user prior to the use of combat helmet 100. Further, combat helmet 100 could be configured to allow a user to adjust the amount of fill/inflation of custom fit system 130 during the wearing thereof for comfort and/or adaptation to situation needs. For example, a snug fit might be required when user was moving while a looser fit might be desired when the user is at rest. A variety of inflator/deflator systems (not shown) could be coupled to valve 131. Such inflator/deflator systems could range from simple manual systems (e.g., bladder pump, straw, etc.) to more complex compressed gas systems without departing from the scope of the present invention. Furthermore, it is to be understood that valve 131 could be realized by separate inflation and deflation ports/valves without departing from the scope of the present invention.

Figure 6:
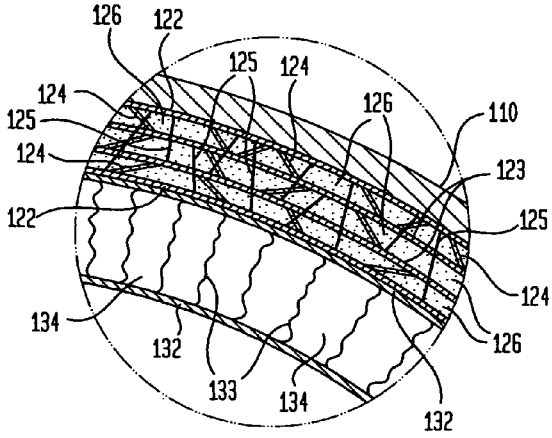
FIG. 6 is an enlarged detailed cross-sectional view of the lightweight combat helmet taken from FIG. 5B in accordance with an embodiment of the present invention.

By way of example, an embodiment of combat helmet 100 is shown in cross-section in FIG. 6. The relative scale of the elements comprising the embodiments of trajectory altering system 120 and custom fit system 130 are exaggerated for clarity of illustration. Both of systems 120 and 130 are illustrated in their filled/inflated state.

Trajectory altering system 120 has an outer flexible receptacle or bladder 122 made from a fluid-impermeable material. Bladder 122 is analogous to wall structure 12 described in conjunction with FIGS. 1-4 above. Within bladder 122 are ballistic fabric sheets 123 and 124 that are analogous to sheets 22 and 24, respectively, described in conjunction with FIGS. 1-4 above. More specifically, sheets 123 somewhat mimic the shape of helmet shell 110 to encase the wearer's head while sheets 124 extend between and are coupled to sheets 123 at various angles with respect thereto. Sheets 123 and 124 are coupled together in their spaced apart relationship by flexible lines 125 coupled to opposing walls of bladder 122 or to at least one wall and one of sheets 123, as illustrated. Flexible lines 125 can be "drop stitches" described earlier herein. The shape of bladder 122 and the relative positions of sheets 123/124 and lines 125 are fixed when bladder 122 is further filled/inflated such that lines 125 are placed in tension. Thus, the length and placement of lines 125 can be used to govern the ultimate shape of bladder 122. In the illustrated embodiment, expandable foam 126 fills the spacing around sheets 123/124 and lines 125. Air, another gas, or other fluid substance could also be used in place of foam 126 without departing from the scope of the present invention.

Custom fit system 130 has its own outer flexible receptacle or bladder 132 that is also made from a fluid-impermeable material that can be the same or different than the material used for bladder 122. The opposing walls of bladder 132 have flexible lines 133 coupled thereto. In contrast to flexible lines 125 that are placed in tension by the filling/inflation of bladder 122, lines 133 are placed in a loose tension state when bladder 132 is further filled with air 134. In this way, bladder 132 will easily conform to one's head and can be readily shifted on the head even after bladder 132 is inflated. Air 134 could be replaced with another gas, fluid, or foam without departing from the scope of the present invention.

The advantages of the present invention are numerous. The lightweight combat helmet only requires a thin outer helmet shell since most of the projectile protection comes from the lightweight inflatable trajectory altering system. Thus, the present invention provides the necessary projectile and blast protection at a fraction of the weight of conventional combat helmets thereby improving user comfort and reducing user fatigue. The custom fit system will allow a user to adjust the helmet's fit for their head and/or to satisfy the requirements of a particular situation. An added benefit of the present invention is that the combat helmet is buoyant when placed in water. Thus, the combat helmet will help keep one's head above the water's surface in the event of a swim/float situation.

Figure 7:
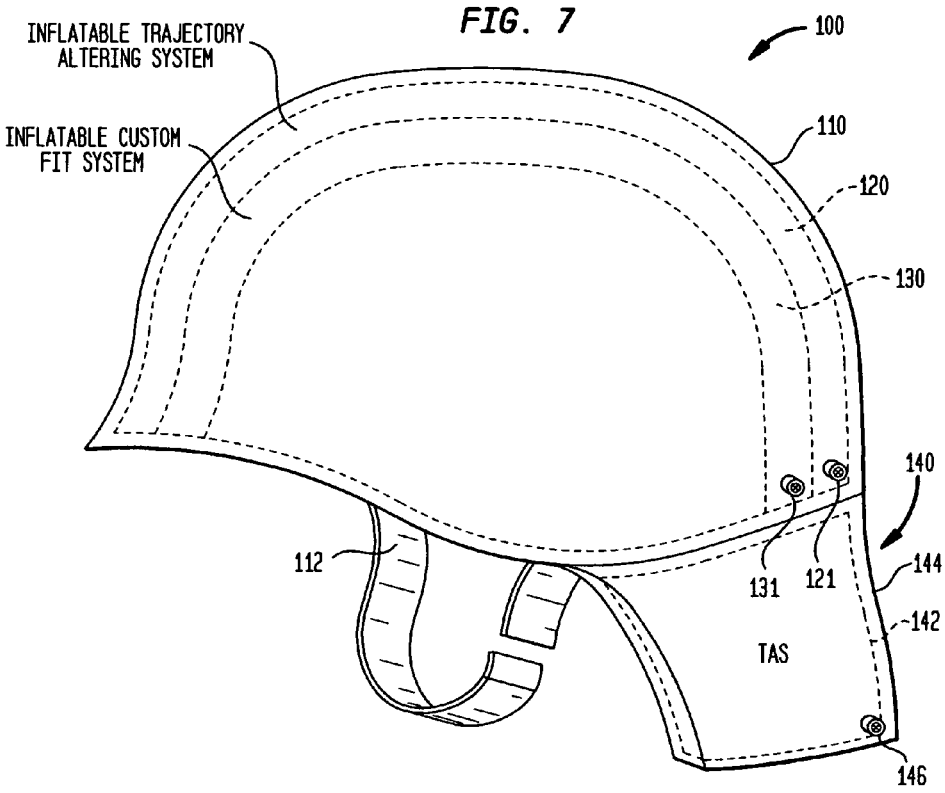
FIG. 7 is a side schematic view of the lightweight combat helmet further including a lightweight neck shield incorporating an inflatable trajectory altering system.

Although the invention has been described relative to a specific embodiment thereof, there are numerous variations and modifications that will be readily apparent to those skilled in the art in light of the above teachings. For example, the chin strap could additionally or alternatively be coupled to or made integral with either or both of systems 120 and 130. In addition, the combat helmet of the present invention could have a neck shield 140 coupled thereto as illustrated in FIG. 7. Neck shield 140 has a trajectory altering system ("TAS") 142 encased in a ballistic fabric 144. Similar to trajectory altering system 120, system 142 will include a flexible and fluid-impermeable bladder filled with material/substances that will alter trajectory of an incoming projectile. System 142 can be inflated with air or other gas, a foam, etc., using a valve 146 that communicates with trajectory altering system 142. Neck shield 140 can be attached to combat helmet 100 when needed/desired to further protect the wearer's neck. A variety of attachment systems can be used to couple neck shield 140 to combat helmet 100 without departing from the scope of the present invention. It is therefore to be understood that, within the scope of the appended claims, the invention may be practiced other than as specifically described.

What is claimed as new and desired to be secured by Letters Patent of the United States is:

1. A lightweight combat helmet, comprising:

a rigid helmet shell having a concave inner surface;

a trajectory altering system including a first receptacle that is inflatable, flexible and fluid impermeable wherein, when inflated, said first receptacle defines a helmet shape nestable within said helmet shell and coupled to said concave inner surface thereof, said first receptacle having a contiguous interior region spanning said helmet shape, said trajectory altering system further including first means disposed in said first receptacle for altering a trajectory of a projectile entering said first receptacle; and a custom fit system including a second receptacle that is inflatable, flexible and fluid impermeable wherein, when inflated, said second receptacle nests within said first receptacle, said second receptacle having a contiguous interior region, said custom fit system further including second means disposed in said second receptacle wherein, when inflated, said second receptacle is adapted to conform to a wearer's head.

2. A lightweight combat helmet as in claim 1 further comprising a chin strap coupled to at least one of said helmet shell, said first receptacle and said second receptacle.

3. A lightweight combat helmet as in claim 1 wherein said first means comprises:

a plurality of sheets of ballistic fabric; and a plurality of flexible lines coupled to walls of said first receptacle and passing through at least a portion of said sheets wherein, when said first receptacle is inflated, said flexible lines are placed in tension and said sheets are maintained in a spaced-apart relationship within said first receptacle.

4. A lightweight combat helmet as in claim 3 wherein said first receptacle is inflated with a gas.

5. A lightweight combat helmet as in claim 3 wherein said first receptacle is inflated with a foam.

6. A lightweight combat helmet as in claim 3 further comprising a plurality of shaped objects dispersed between said sheets and said flexible lines.

7. A lightweight combat helmet as in claim 1 wherein said second means comprises a plurality of flexible lines coupled to walls of said second receptacle.

8. A lightweight combat helmet as in claim 1 wherein said second receptacle is inflated with a material selected from the group consisting of a gas and a foam.

9. A lightweight combat helmet as in claim 1 further comprising a first valve coupled to said first receptacle for facilitating inflation of said first receptacle.

10. A lightweight combat helmet as in claim 1 further comprising a second valve coupled to said second receptacle for facilitating inflation of said second receptacle.

11. A lightweight combat helmet as in claim 1 further comprising an auxiliary ballistic shield coupled to said helmet shell and adapted to drape therefrom adjacent to the wearer's neck.

12. A lightweight combat helmet as in claim 11 wherein said auxiliary ballistic shield comprises:

a third receptacle that is flexible and fluid impermeable;

third means filling said third receptacle, said third means altering a trajectory of a projectile entering said third receptacle; and a fabric encasing said third receptacle and conformable thereto when said third means fills said third receptacle, said fabric having ballistic armor attributes.

13. A lightweight combat helmet as in claim 1 wherein said helmet shell further defines a convex outer shape, and wherein at least one of said convex outer surface and said concave inner surface is covered with a coating having particles of material mixed therein, wherein said particles are selected from the group consisting of diamonds and carborundum.

14. A lightweight combat helmet, comprising:

a rigid helmet shell having a concave inner surface;

a trajectory altering system including a first receptacle that is inflatable, flexible and fluid impermeable wherein, when inflated, said first receptacle defines a helmet shape nestable within said helmet shell and coupled to said concave inner surface thereof, said first receptacle having a contiguous interior region spanning said helmet shape, said trajectory altering system further including first means disposed in said first receptacle for altering a trajectory of a projectile entering said first receptacle;

a first valve coupled to said first receptacle for facilitating inflation of said first receptacle;

a custom fit system including a second receptacle that is inflatable, flexible and fluid impermeable wherein, when inflated, said second receptacle nests within said first receptacle, said second receptacle having a contiguous interior region, said custom fit system further including second means disposed in said second receptacle wherein, when inflated, said second receptacle is adapted to conform to a wearer's head; and a second valve coupled to said second receptacle for facilitating inflation of said second receptacle.

15. A lightweight combat helmet as in claim 14 further comprising a chin strap coupled to at least one of said helmet shell, said first receptacle and said second receptacle.

16. A lightweight combat helmet as in claim 14 wherein said first means comprises:

a plurality of sheets of ballistic fabric; and a plurality of flexible lines coupled to walls of said first receptacle and passing through at least a portion of said sheets wherein, when said first receptacle is inflated, said flexible lines are placed in tension and said sheets are maintained in a spaced-apart relationship within said first receptacle.

17. A lightweight combat helmet as in claim 16 wherein said first receptacle is inflated with a gas.

18. A lightweight combat helmet as in claim 16 wherein said first receptacle is inflated with a foam.

19. A lightweight combat helmet as in claim 16 further comprising a plurality of shaped objects dispersed between said sheets and said flexible lines.

20. A lightweight combat helmet as in claim 14 wherein said second means comprises a plurality of flexible lines coupled to walls of said second receptacle.

21. A lightweight combat helmet as in claim 14 wherein said second receptacle is inflated with a material selected from the group Consisting of a gas and a foam.

22. A lightweight combat helmet as in claim 14 further comprising an auxiliary ballistic shield coupled to said helmet shell and adapted to drape therefrom adjacent to the wearer's neck.

23. A lightweight combat helmet as in claim 22 wherein said auxiliary ballistic shield comprises:

a third receptacle that is flexible and fluid impermeable;

third means filling said third receptacle, said third means altering a trajectory of a projectile entering said third receptacle; and a fabric encasing said third receptacle and conformable thereto when said third means fills said third receptacle, said fabric having ballistic armor attributes.

24. A lightweight combat helmet as in claim 14 wherein said helmet shell further defines a convex outer shape, and wherein at least one of said convex outer surface and said concave inner surface is covered with a coating having particles of material mixed therein, wherein said particles are selected from the group consisting of diamonds and carborundum.

25. A lightweight combat helmet, comprising:

a rigid helmet shell having a concave inner surface;

a trajectory altering system including a first receptacle that is inflatable, flexible and fluid impermeable wherein, when inflated, said first receptacle defines a helmet shape nestable within said helmet shell and coupled to said concave inner surface thereof, said first receptacle having a contiguous interior region spanning said helmet shape, said trajectory altering system further including first means disposed in said first receptacle, said first means including plurality of sheets of ballistic fabric, a first plurality of drop stitches coupled to walls of said first receptacle and passing through at least a portion of said sheets, and a first substance for inflating said first receptacle wherein said first plurality of drop stitches are placed in tension and wherein said sheets are maintained in a spaced-apart relationship within said first receptacle;

a first valve coupled to said first receptacle for facilitating the introduction of said first substance under pressure into said first receptacle;

a custom fit system including a second receptacle that is inflatable, flexible and fluid impermeable wherein, when inflated, said second receptacle nests within said first receptacle, said second receptacle having a contiguous interior region spanning said helmet shape, said custom fit system further including second means disposed in said second receptacle, said second means including a second plurality of drop stitches coupled to walls of said second receptacle and a second substance for inflating said second receptacle wherein said second plurality of drop stitches are placed in loose tension and said second receptacle is adapted to conform to a wearer's head; and a second valve coupled to said second receptacle for facilitating the introduction of said second substance under pressure into said second receptacle; and a chin strap coupled to at least one of said helmet shell, said first receptacle and said second receptacle.

26. A lightweight combat helmet as in claim 25 wherein said first substance is selected from the group consisting of a gas and a foam.

27. A lightweight combat helmet as in claim 25 wherein said second substance is selected from the group consisting of a gas and a foam.

28. A lightweight combat helmet as in claim 25 further comprising a plurality of shaped objects dispersed between said sheets and said first plurality of drop stitches.

29. A lightweight combat helmet as in claim 25 further comprising an auxiliary ballistic shield coupled to said helmet shell and adapted to drape therefrom adjacent to the wearer's neck.

30. A lightweight combat helmet as in claim 29 wherein said auxiliary ballistic shield comprises:

a third receptacle that is flexible and fluid impermeable;

third means filling said third receptacle, said third means altering a trajectory of a projectile entering said third receptacle; and a fabric encasing said third receptacle and conformable thereto when said third means fills said third receptacle, said fabric having ballistic armor attributes.

31. A lightweight combat helmet as in claim 25 wherein said helmet shell further defines a convex outer shape, and wherein at least one of said convex outer surface and said concave inner surface is covered with a coating having particles of material mixed therein, wherein said particles are selected from the group consisting of diamonds and carborundum.

* * * * *